US010689906B2

(12) United States Patent
Ziaylek et al.

(10) Patent No.: US 10,689,906 B2
(45) Date of Patent: Jun. 23, 2020

(54) SYSTEMS FOR STORING AND RETRIEVING LADDERS AND OTHER OBJECTS

(71) Applicant: Michael P. Ziaylek, Yardley, PA (US)

(72) Inventors: Michael P. Ziaylek, Yardley, PA (US); W. Brian McGinty, Huntingdon Valley, PA (US)

(73) Assignee: Michael P. Ziaylek, Yardley, PA (US)

( * ) Notice: Subject to any disclaimer, the term of this patent is extended or adjusted under 35 U.S.C. 154(b) by 21 days.

(21) Appl. No.: 15/961,403

(22) Filed: Apr. 24, 2018

(65) Prior Publication Data

US 2019/0323292 A1 Oct. 24, 2019

(51) Int. Cl.
*E06C 5/04* (2006.01)
*E06C 5/42* (2006.01)

(52) U.S. Cl.
CPC . *E06C 5/42* (2013.01); *E06C 5/04* (2013.01)

(58) Field of Classification Search
CPC ..... E06C 5/42; E06C 5/04
USPC ..... 224/310
See application file for complete search history.

(56) References Cited

U.S. PATENT DOCUMENTS

| | | | |
|---|---|---|---|
| 1,890,940 | A | 12/1932 | Fox |
| 1,898,826 | A | 2/1933 | Fox |
| 1,899,742 | A | 2/1933 | Bay |
| 2,005,990 | A | 6/1935 | Darley |
| 2,116,470 | A | 5/1938 | Kiley et al. |
| 2,586,531 | A | 2/1952 | Gordon |
| 2,946,397 | A | 7/1960 | Berberich |
| 3,013,681 | A | 12/1961 | Garnett |
| 3,058,607 | A | 10/1962 | Kiley |
| 3,563,342 | A | 2/1971 | Lasiter |
| 3,621,935 | A | 11/1971 | Bode |
| 3,672,549 | A | 6/1972 | Chorey |
| 4,058,243 | A | 11/1977 | Tappan |
| 4,059,281 | A | 11/1977 | Evans |
| 4,062,464 | A | 12/1977 | Grove |
| 4,139,078 | A | 2/1979 | Keller |
| 4,161,997 | A | 7/1979 | Norman |
| 4,170,331 | A | 10/1979 | Faulstich |
| 4,234,285 | A | 11/1980 | Martinez |
| 4,239,438 | A | 12/1980 | Everson |
| 4,344,508 | A | 8/1982 | Peck |
| 4,408,680 | A | 10/1983 | Ross |

(Continued)

OTHER PUBLICATIONS

Product information sheet for AS Powerbeam Gantry, retrieved from website http://www.supplyplus.com/p/15/as-fire-and-safety-powerbeam-gantry.

(Continued)

*Primary Examiner* — Alvin C Chin-Shue
(74) *Attorney, Agent, or Firm* — Fox Rothschild LLP; Robert J. Sacco; Frank T. Carroll

(57) ABSTRACT

Systems are provided for storing and retrieving objects such as ladders. The systems can include a carriage having a table that rotates, and a trolley mounted on the carriage for holding the object and moving the object linearly in relation to the carriage, so that the object can be stowed in locations such as on the roof of a fire engine or other emergency vehicle, or the roof of a stationary structure. The systems include features for locking the table and the trolley to increase the safety and efficiency of the loading and unloading processes.

19 Claims, 15 Drawing Sheets

(56) References Cited

U.S. PATENT DOCUMENTS

| | | | | |
|---|---|---|---|---|
| 4,603,908 | A * | 8/1986 | Weaver | B60P 1/283 298/17 R |
| 4,618,083 | A | 10/1986 | Weger, Jr. | |
| 4,738,582 | A | 4/1988 | Roberts | |
| 4,751,981 | A | 6/1988 | Mitchell et al. | |
| 4,827,742 | A | 5/1989 | McDonald | |
| 4,858,725 | A | 8/1989 | Griffin | |
| 4,877,108 | A | 10/1989 | Griffin et al. | |
| 4,909,352 | A | 3/1990 | McComb | |
| 4,953,757 | A | 9/1990 | Stevens et al. | |
| 5,009,350 | A | 4/1991 | Schill et al. | |
| 5,048,641 | A | 9/1991 | Holcomb et al. | |
| 5,064,022 | A | 11/1991 | Graham | |
| 5,071,308 | A | 12/1991 | Tibbet | |
| 5,104,280 | A | 4/1992 | Ziaylek et al. | |
| D331,030 | S | 11/1992 | Ziaylek et al. | |
| 5,172,952 | A | 12/1992 | Lasnetski | |
| 5,297,912 | A | 3/1994 | Levi | |
| 5,421,495 | A | 6/1995 | Bubik et al. | |
| 5,447,408 | A | 9/1995 | Smith | |
| 5,469,933 | A | 11/1995 | Thomason | |
| 5,518,357 | A | 5/1996 | Ziaylek | |
| 5,538,100 | A | 7/1996 | Hedley | |
| 5,632,591 | A | 5/1997 | Henriquez | |
| 5,743,702 | A | 4/1998 | Gunderson | |
| 5,791,857 | A | 8/1998 | Ziaylek, Jr. et al. | |
| 5,850,891 | A | 12/1998 | Olms et al. | |
| 6,003,633 | A | 12/1999 | Rolson | |
| 6,012,545 | A | 1/2000 | Faleide | |
| 6,029,750 | A | 2/2000 | Carrier | |
| 6,092,972 | A | 7/2000 | Levi | |
| 6,257,534 | B1 | 7/2001 | Finley | |
| 6,315,181 | B1 | 11/2001 | Bradley et al. | |
| 6,378,654 | B1 * | 4/2002 | Ziaylek, Jr. | B60R 3/005 182/127 |
| 6,427,889 | B1 | 8/2002 | Levi | |
| 6,827,541 | B1 | 12/2004 | Ziaylek et al. | |
| 6,832,667 | B1 * | 12/2004 | Kahre | B60P 1/43 182/127 |
| 7,137,479 | B2 * | 11/2006 | Ziaylek | B60R 9/0423 182/127 |
| D545,263 | S | 6/2007 | Ziaylek et al. | |
| 7,992,682 | B2 | 8/2011 | Ziaylek | |
| 8,297,635 | B2 | 10/2012 | Agoncillo et al. | |
| 8,985,933 | B2 | 3/2015 | Ziaylek et al. | |
| D729,142 | S | 5/2015 | Ziaylek et al. | |
| 9,194,180 | B2 * | 11/2015 | Hedley | E06C 5/02 |
| 9,526,932 | B1 * | 12/2016 | Ziaylek | A62C 27/00 |
| 2004/0052622 | A1 | 3/2004 | Chisnall | |
| 2011/0148057 | A1 * | 6/2011 | Barrott | B63C 13/00 280/43.18 |
| 2012/0263561 | A1 * | 10/2012 | Li | B60R 9/0423 414/462 |
| 2013/0181091 | A1 * | 7/2013 | Evans | B64C 25/26 244/102 A |
| 2016/0221510 | A1 * | 8/2016 | Petersen | B60R 3/02 |

OTHER PUBLICATIONS

Product information sheet for AS Beam Gantry Retro-Kit, retrieved from website http://www.supplypluscom/p/17/as-fire-safety-gantry-retro-kit.

Product information sheet for AS Beam Gantries, retrieved from website http://www.supplyplus.com/p/10/as-fire-safety-beam-gantries.

* cited by examiner

SYSTEMS FOR STORING AND RETRIEVING LADDERS AND OTHER OBJECTS

BACKGROUND

Statement of the Technical Field

The inventive concepts disclosed herein relate to systems for storing and retrieving objects such as ladders. The systems can be used in connection with emergency vehicles such as fire engines, with other type of vehicles, and with stationary structures.

Description of the Related Art

Modern firefighting requires the use of many different types of equipment. This equipment typically is transported to the site of a fire by an emergency vehicle such as a fire engine. Due to the urgent nature of most firefighting operations, the equipment needs to be quickly and easily accessible to the firefighters and other emergency personnel. Consequently, the amount of suitable space for the storage of firefighting equipment on a typical fire engine is limited.

In response to the demand for equipment storage space on emergency vehicles such as fire engines, systems have been developed for storing ladders and other emergency equipment in the otherwise unused space on top of emergency vehicles. To facilitate retrieval of the ladder, some systems use a frame that is mounted on the roof of the emergency vehicle in a manner that permits the frame, and the ladder attached thereto, to be moved rearward in relation to the roof until a portion of the frame and ladder overhang the back of the vehicle. The frame and ladder then can be tilted to provide emergency personnel on the ground with access to the ladder. The ladder and frame are relatively heavy, however, and can be difficult to balance and otherwise handle as they are moved off of the roof and into a position accessible to the emergency responders. These difficulties can be exacerbated by the need for emergency responders to act quickly, and in all type of weather and lighting conditions; and by the height of the roof above the ground, which can limit physical and visual access to the ladder and frame.

SUMMARY

Systems for storing and retrieving an object include a carriage having a table configured to rotate between a first and a second angular position in relation to a mounting surface for the system, and a trolley mounted on the carriage and configured to hold the object. The systems also include a locking mechanism having a linkage. The linkage includes a first member pivotally coupled to the table at a first pivot point, and a second member configured to be pivotally coupled to the mounting surface at a second pivot point. The second member is pivotally coupled to the first member at a third pivot point. Interfering contact between the first and second members prevents movement of the table past the second angular position.

Systems for storing and retrieving an object can also comprise a carriage comprising a table configured to rotate between a first and a second angular position in relation to a mounting surface for the system, and a trolley mounted on the carriage and configured to hold the object. The systems also include a first locking mechanism having a linkage. The linkage includes a first member pivotally coupled to the table, and a second member pivotally coupled to the first member and configured to be pivotally coupled to the mounting surface. The linkage is configured so that the linkage is collapsed when the table is in the first angular position, and the pivot point undergoes over-center rotation as the table moves from the first to the second angular position.

BRIEF DESCRIPTION OF THE DRAWINGS

Embodiments will be described with reference to the following drawing figures, in which like numerals represent like items throughout the figures and in which.

DETAILED DESCRIPTION

The inventive concepts are described with reference to the attached figures. The figures are not drawn to scale and they are provided merely to illustrate the instant inventive concepts. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts. The inventive concepts are not limited by the illustrated ordering of acts or events, as some acts may occur in different orders and/or concurrently with other acts or events. Furthermore, not all illustrated acts or events are required to implement a methodology in accordance with the inventive concepts.

Figure 1:
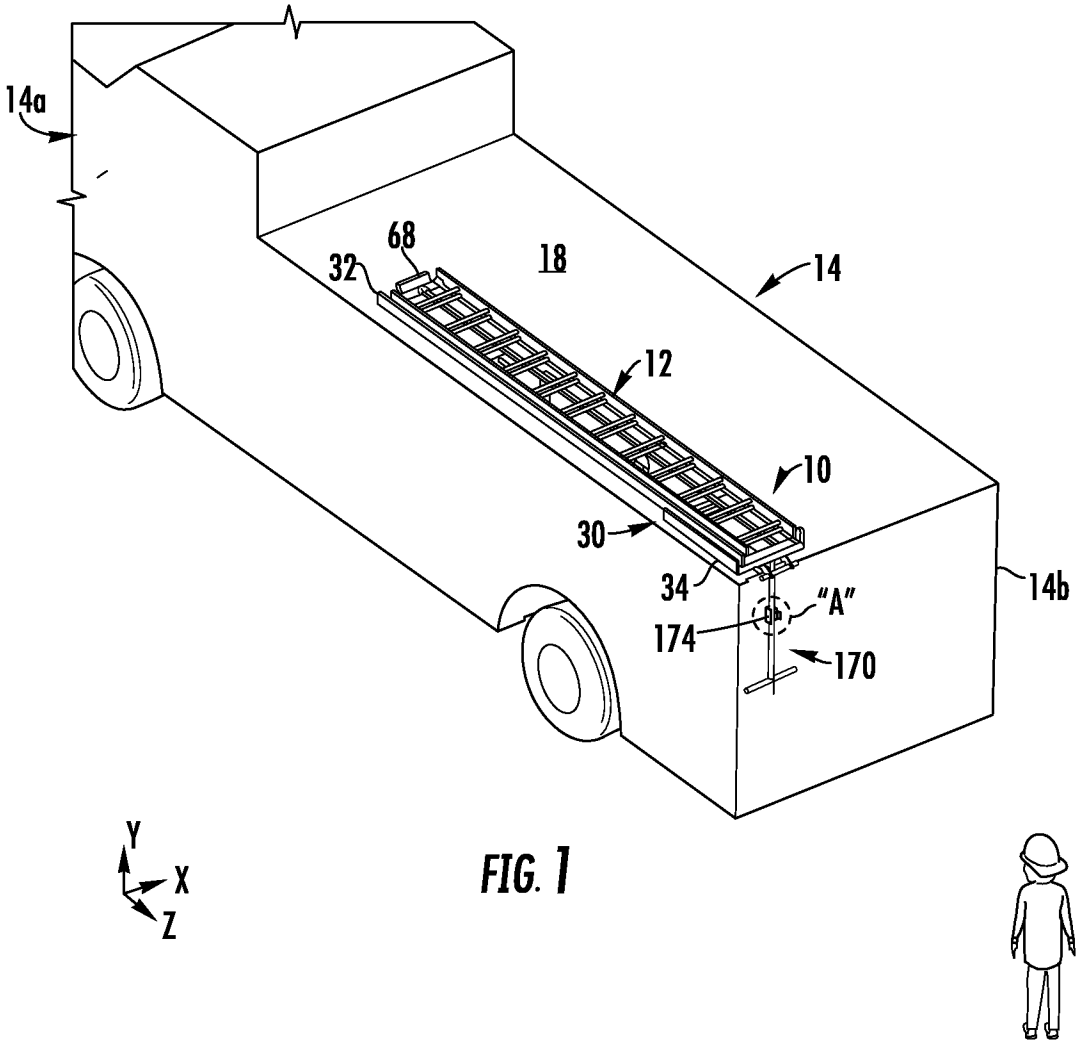
FIG. 1 is a top perspective view, looking forward, of a system for storing and retrieving objects, installed on a fire engine, with a table of the system locked in a horizontal position, and a trolley of the system in its forward position; and with a ladder in its stowed position on the trolley.
Figure 2:
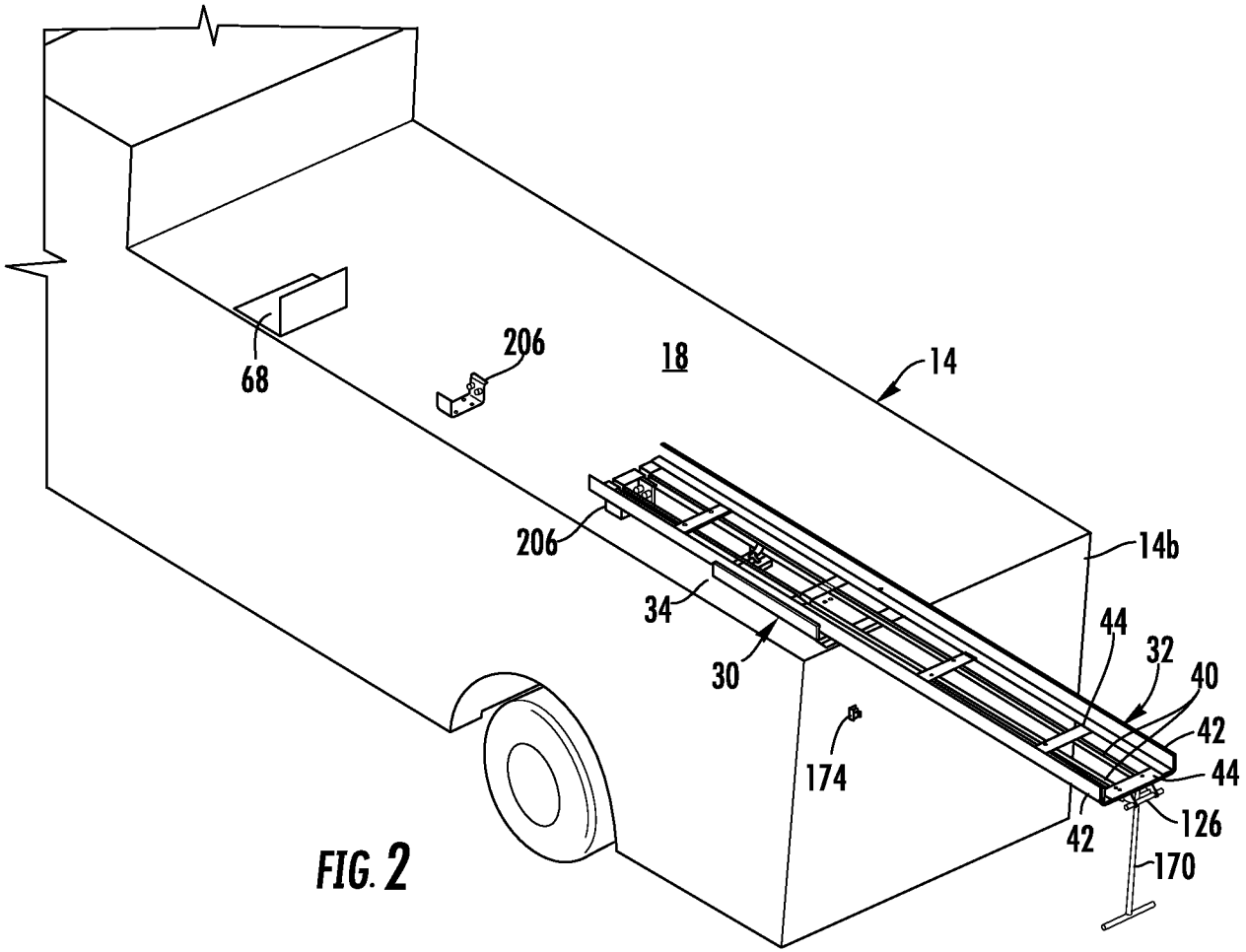
FIG. 2 is a top perspective view, looking forward, of the system shown in FIG. 1, with the table locked in its horizontal position, and the trolley in a rearwardly-extended horizontal position.
Figure 3:
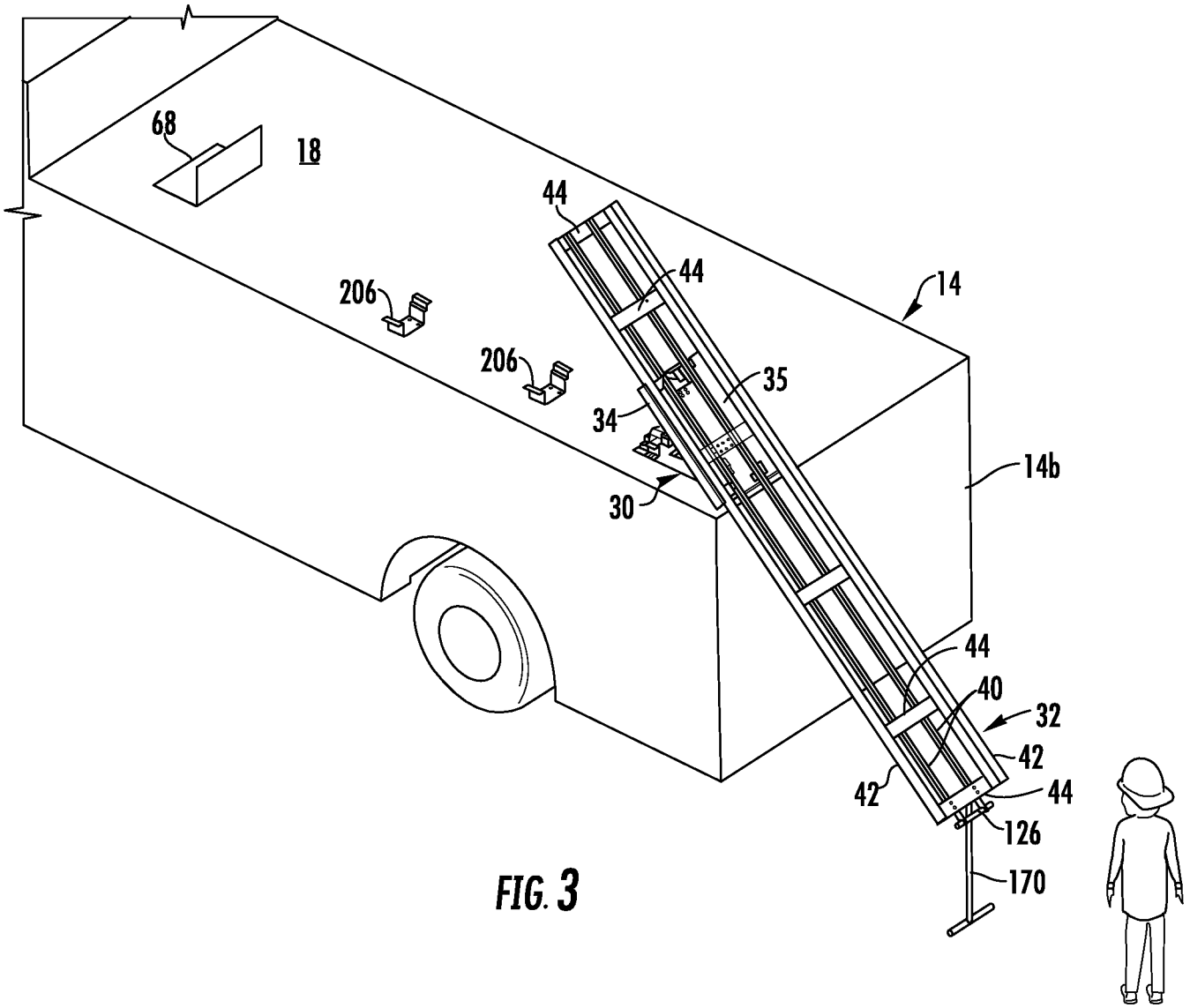
FIG. 3 is a top perspective view, looking forward, of the system shown in FIGS. 1 and 2, with the table locked in an inclined position, and the trolley in a rearwardly-extended inclined position; and with the ladder removed from the trolley.

FIGS. 1-14 depict a system 10 for storing and retrieving objects such as a ladder 12. The system 10 can be mounted on a fire engine 14 as shown in FIGS. 1-3. This particular use is disclosed for exemplary purposes only; the system 10 can be mounted on other types of firefighting equipment and other types of vehicles. The system 10 can also be mounted on stationary structures, such as the roof of a shed or a building. In addition, the system 10 can be used to store and retrieve objects other than ladders.

The system 10 is a mounted on a mounting surface. In the exemplary application disclosed herein, the mounting surface is a substantially flat, upper exterior surface 18 of the fire engine 12. The system 10 is configured to move the ladder 12 between a first, or stowed position shown in FIG. 1, and a second, or loading position shown in FIGS. 4 and 5. When in its stowed position, the ladder 12 has a substantially horizontal orientation and is positioned, in its entirety, above the exterior surface 18, with its forward end proximate the forward end 14*a* of the fire engine 14; and its back end proximate the back end 14*b* of the fire engine 14, as shown in FIG. 1. When in the loading position, a portion of the ladder 12 overhangs the back end 14*b* of the fire engine 14, and the ladder 12 is tilted or inclined in relation to the horizontal so that a bottom of the ladder 12 is located proximate the ground, thereby allowing a firefighter or other user to quickly and easily retrieve the ladder 12 while standing on the ground.

Figure 4:
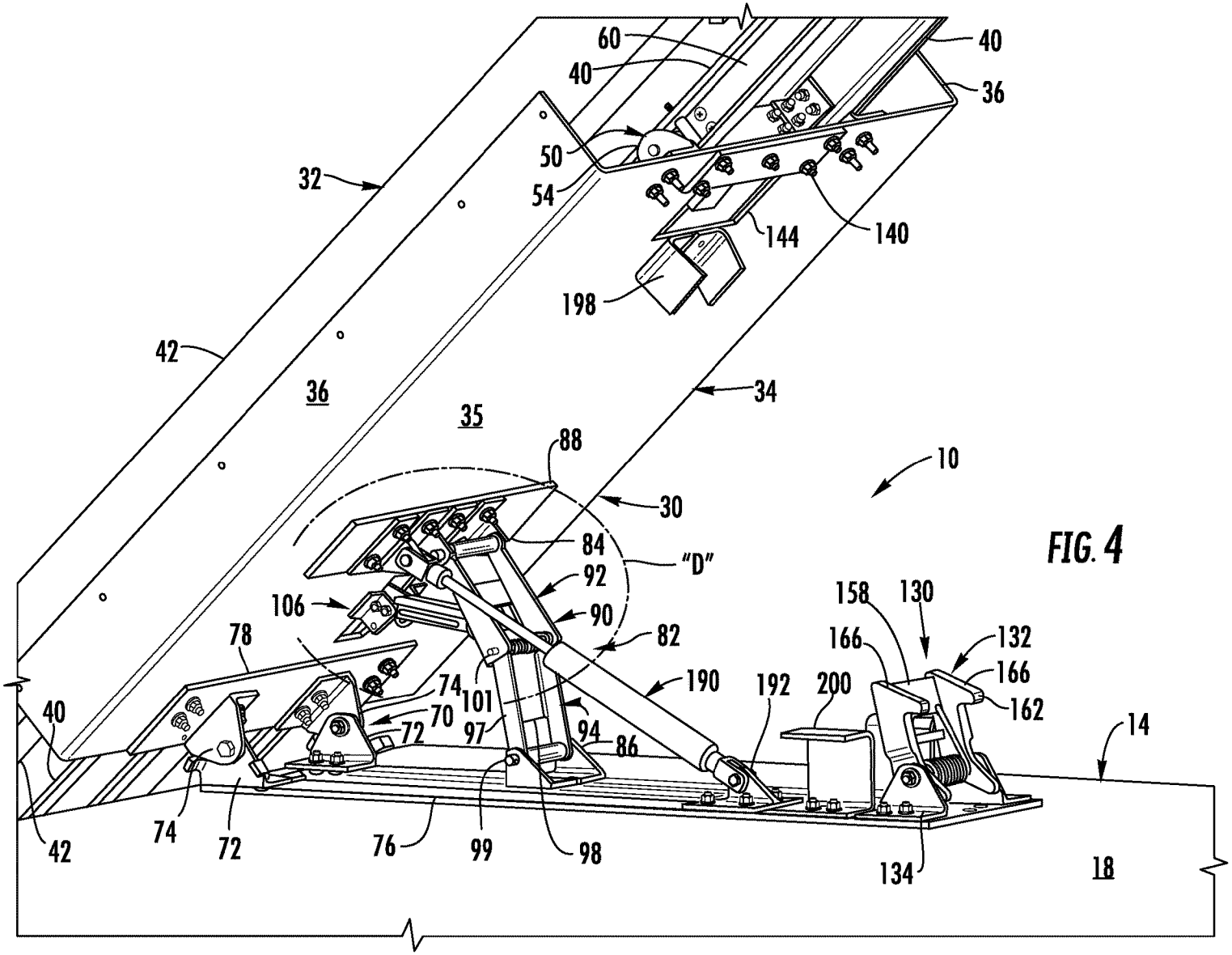
FIG. 4 is a perspective view, looking rearward, of the system shown in FIGS. 1-3, with the table locked in its inclined position, the trolley in its rearwardy-extended inclined position, and the ladder in its loading position.
Figure 5:
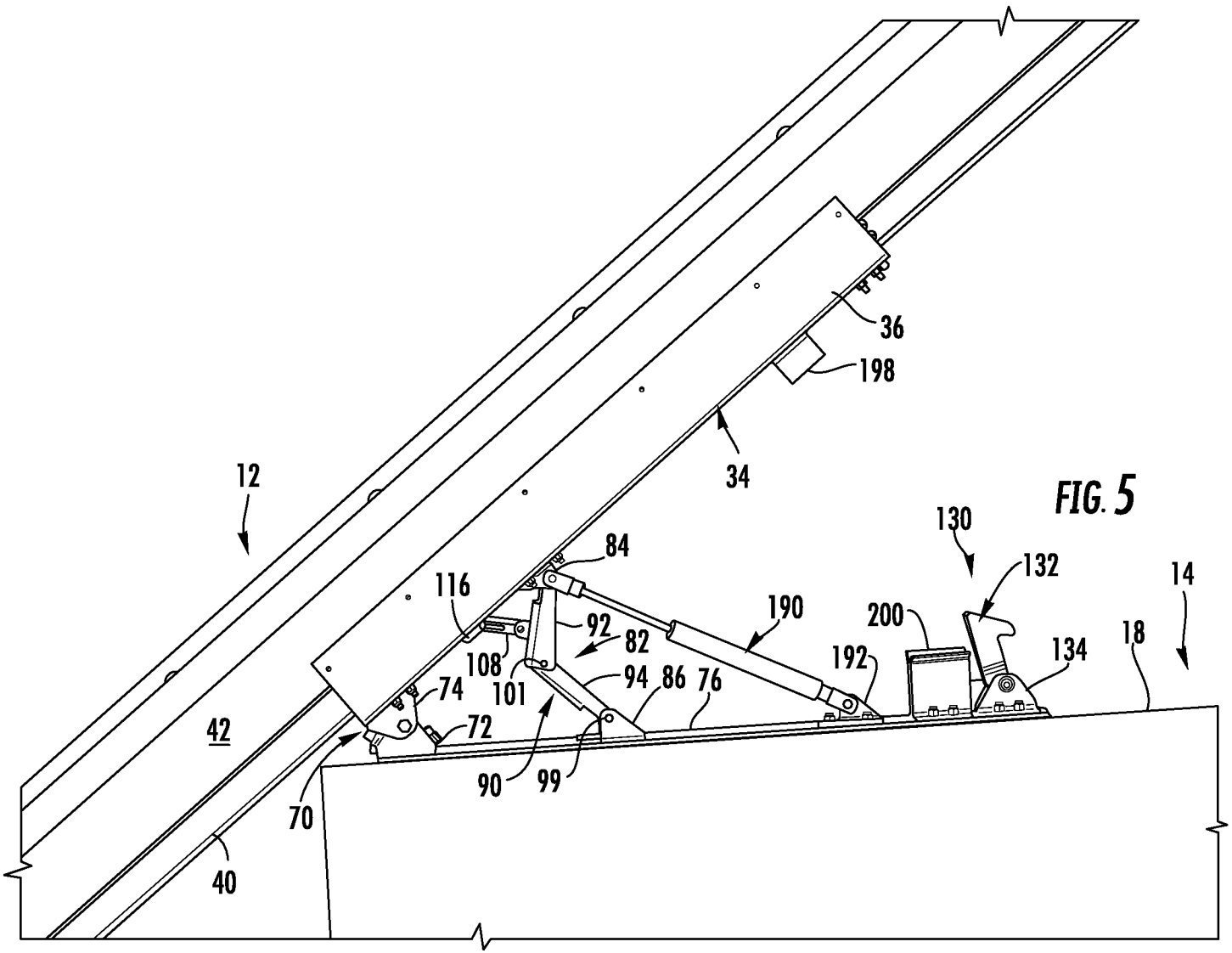
FIG. 5 is a perspective view, looking forward, of the system shown in FIGS. 1-4, with the table locked in its inclined position, the trolley in its rearwardy-extended inclined position, and the ladder in its loading position.
Figure 6:
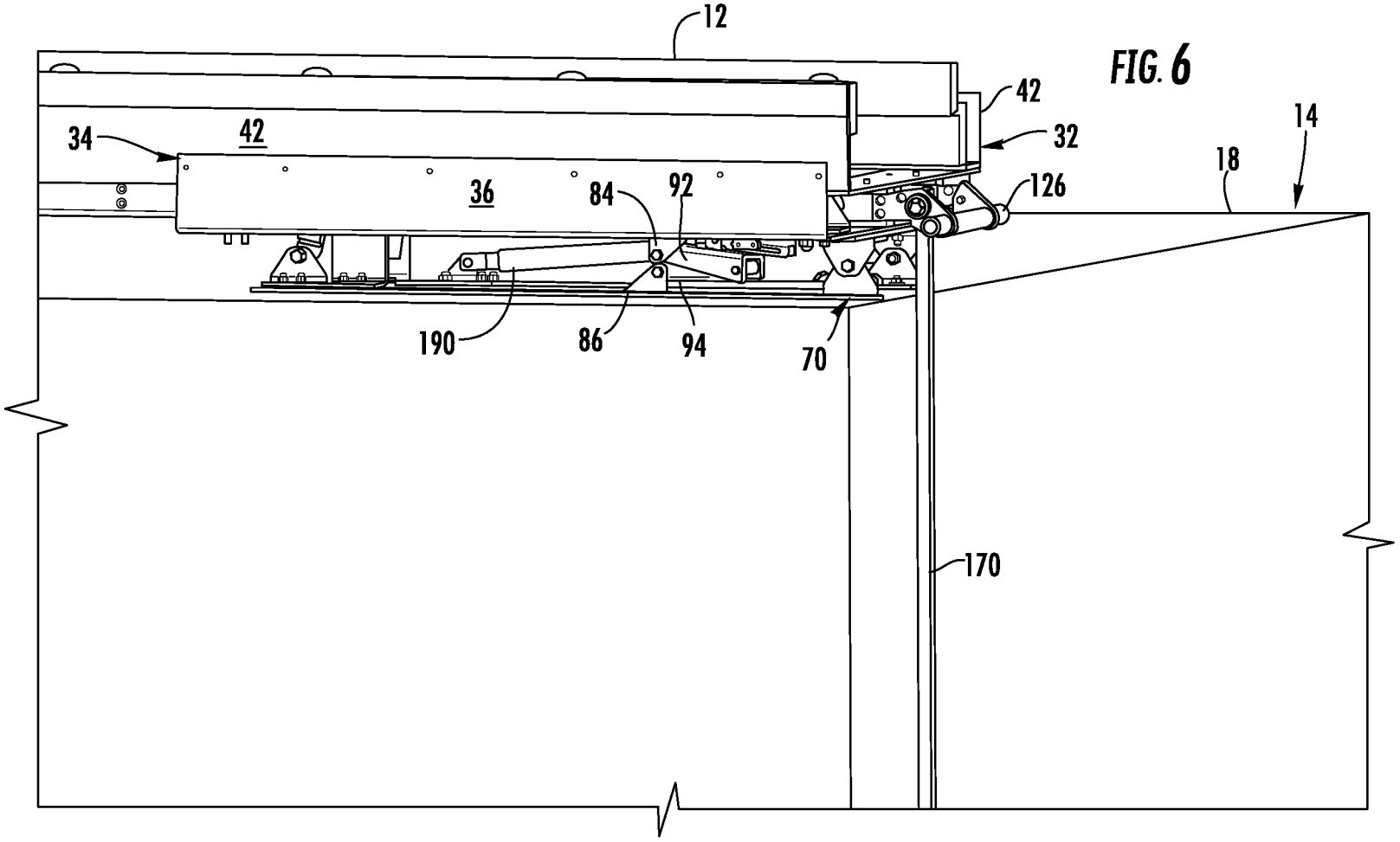
FIG. 6 is a perspective view, looking forward, of the system shown in FIGS. 1-5A, with the table locked in its horizontal position, the trolley in its forward position, and the ladder in its stowed position.

The system 10 comprises a carriage 30, and an elongated trolley 32. The carriage 30 is mounted on the exterior surface 18 of the fire engine 14 by way of a base 76, as shown in FIGS. 4-6. The base 76 is secured to the exterior surface 18 of the fire engine 14 by fasteners or other suitable means.

The trolley 32 is mounted on the carriage 30, and is configured to securely hold the ladder 12 using hook-shaped brackets (not shown) or other suitable features. The carriage 30 comprises a table 34. The table 34 has a substantially flat bottom portion 35, and two sides 36 that adjoin the bottom portion 35 and extend substantially perpendicular to the bottom portion 35 as shown, for example, in FIG. 4. Alternative embodiments of the table 34 can be constructed without the sides 36.

The trolley 32 is mounted on the table 34 as described in detail below. The table 34 is configured to pivot in relation to the fire engine 12, to facilitate tilting of the trolley 32 and the ladder 12. The carriage 30 configured to permit the trolley 32 to move linearly in its lengthwise ("z") direction in relation to the carriage 30, between a forward position shown in FIG. 1, and a rearwardly-extended horizontal position shown in FIG. 2. The forward position of the trolley 32 corresponds to the stowed position of the ladder 12 depicted in FIG. 1. As explained in detail below, when the trolley 32 is moved into the rearwardly-extended position, the trolley 32 automatically becomes free to rotate into and from a rearwardly-extended inclined position shown in FIGS. 3-5, which allows the ladder 12 to be tilted into and from its loading position as shown in FIGS. 4 and 5.

Figure 8:
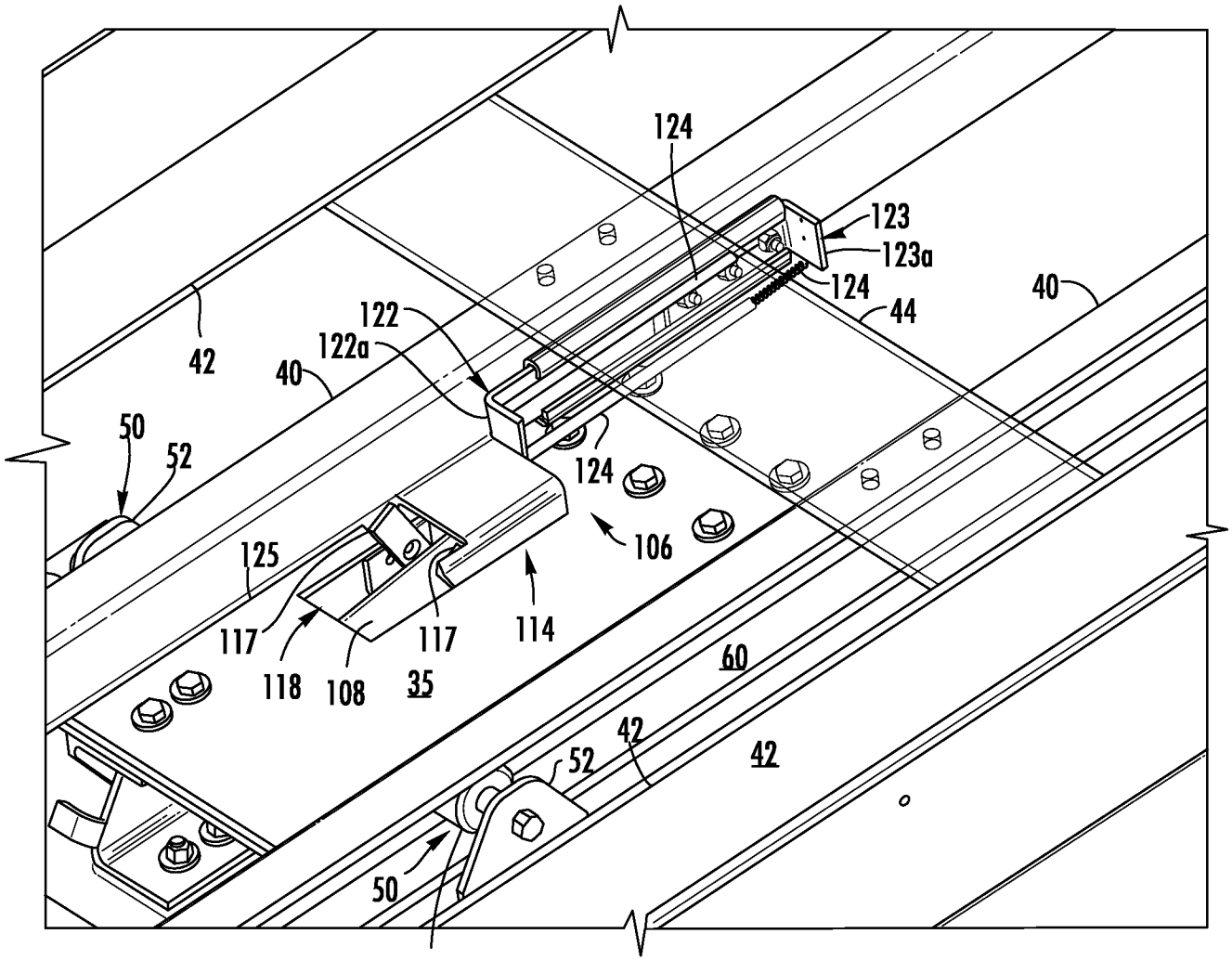
FIG. 8 is a magnified view of the area designated "C" in FIG. 9, without the ladder depicted in FIG. 9.
Figure 9:
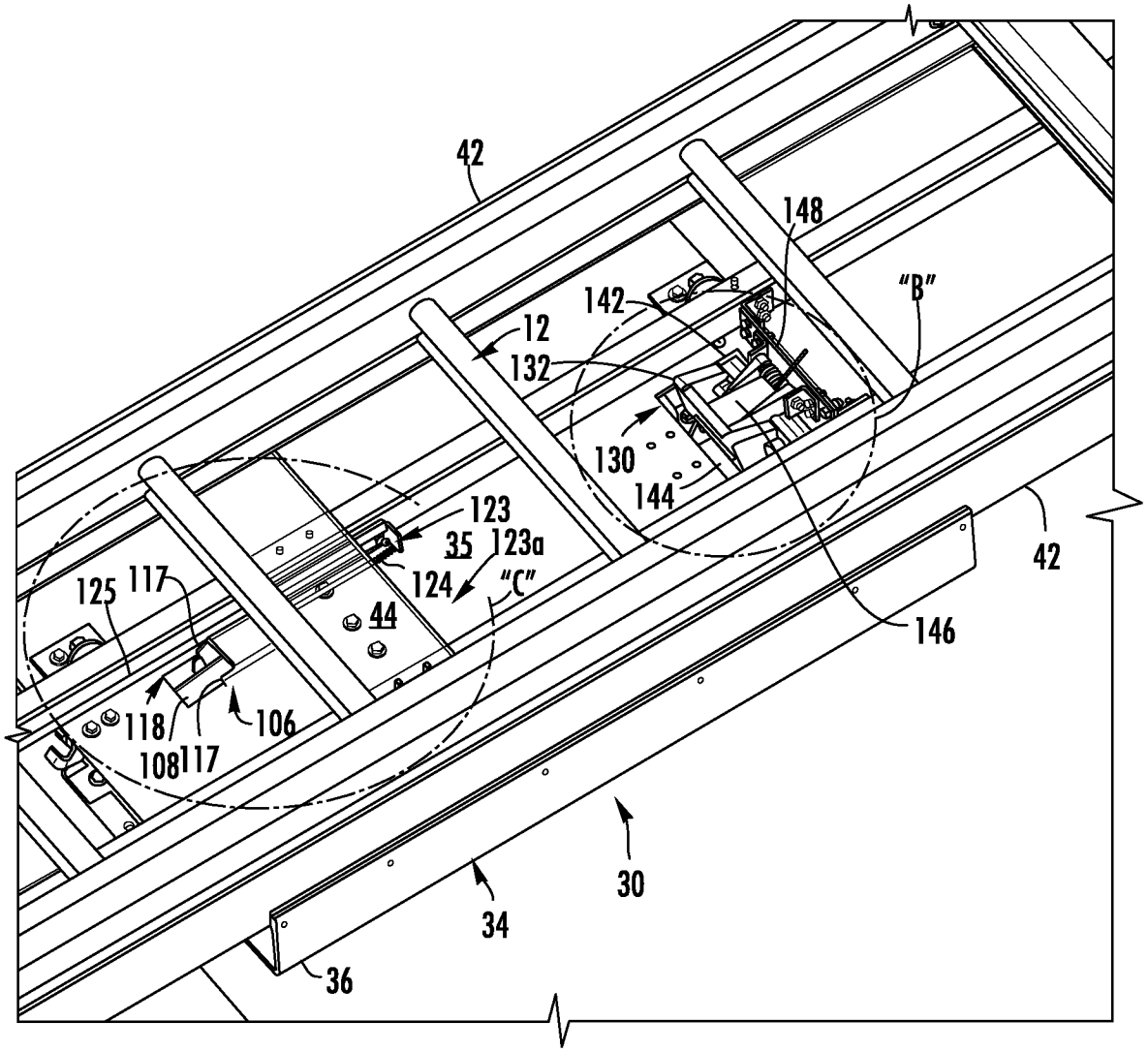
FIG. 9 is a top perspective view, looking forward, of the system shown in FIGS. 1-8, with the table in its horizontal position, and the trolley in its rearwardly-extended, horizontal position, as the table being unlocked to allow the table and trolley to rotate.

The trolley 32 comprises a first and a second rail 40, and a first and a second substantially L-shaped bracket 42 as shown, for example, in FIGS. 3, 8, 9, and 12. The trolley 32 also includes six cross members 44. The first and second rails 40 are substantially parallel, and are attached to the undersides of the cross members 44 by fasteners or other suitable means. The first and second brackets 42 are substantially parallel, and are attached to upper surfaces of the cross members 44 by fasteners or other suitable means. The brackets 42 are spaced apart so that the ladder 12 can be positioned therebetween, as shown in FIG. 9. Alternative embodiments can include more, or less than six cross members 44.

The carriage 30 further comprises four wheel assemblies 50, shown in FIGS. 4, 8, 10, and 12. Each wheel assembly 50 includes a bracket 52, and a wheel 54 mounted for rotation on the bracket 52. Each bracket 52 is secured to an upper surface of the bottom portion 35 of the table 34 by fasteners or other suitable means. The first and second rails 40 each include an outwardly-facing channel 60, as shown in FIGS. 4, 8, 10, 12, and 13. Each channel 60 accommodates two of the wheels 54. The wheels 54 support the trolley 32, and rotate within the channels 60 to facilitate linear movement of the trolley 32 in its lengthwise ("z") direction, between its forward and rearward positions. The wheels 54 also constrain the trolley 32 in the vertical ("y") and lateral ("x") directions, while guiding the trolley 32 in the lengthwise direction. Alternative embodiments can include more, or less than four wheel assemblies 50.

A stop in the form of a pin (not shown) can be mounted on each rail 40 so that the pin protrudes into the channel 60. The pins can be positioned so as to contact the forward-most wheels 54 when the trolley 32 reaches its rearward position, so that further rearward movement of the trolley 32 is prohibited by interfering contact between the wheels 54 and the pins.

A forward stop 68, shown in FIGS. 1-3, can be mounted on the exterior surface 18 of the fire engine 14. The forward stop is positioned so as to interfere with forward movement of the trolley 32 past its forward position. The forward stop 68 can also act to restrain the ladder 12 in the forward direction. Other means for limiting the forward movement of the trolley 32 and the ladder 12 can be used in alternative embodiments.

Figure 7:
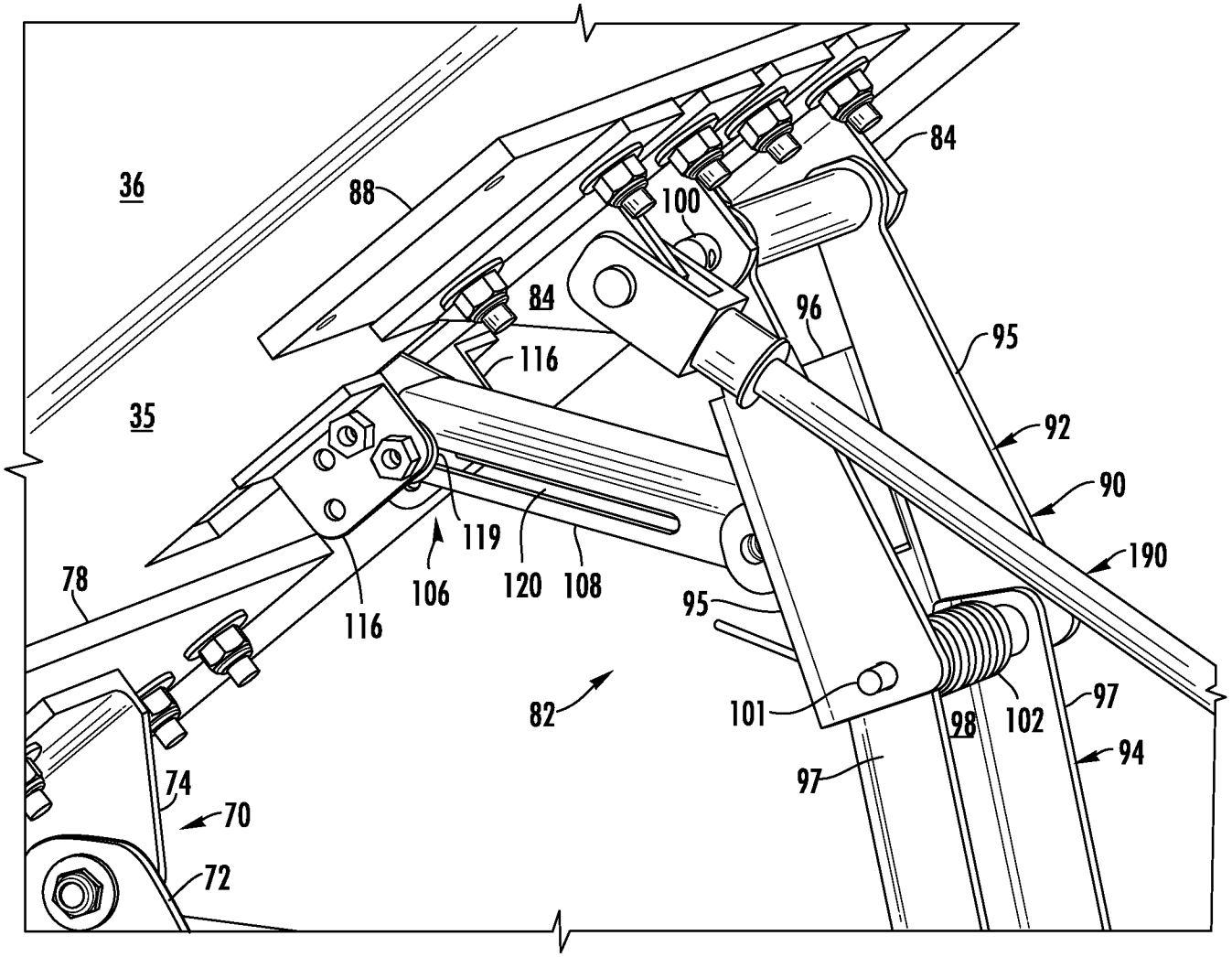
FIG. 7 is a magnified view of the area designated "D" in FIG. 4.

The carriage 30 also includes a mount 70, depicted in FIGS. 4, 5, and 7, that facilitates pivotal movement, or rotation, of the table 34 in relation to the base 76, and the exterior surface 18 of the fire engine 14. The mount 70 includes two stationary brackets 72, and two pivoting brackets 74. Each stationary bracket 72 is secured to the base 76 by fasteners or other suitable means.

Each pivoting bracket 74 is coupled to a corresponding one of the stationary brackets 72 by way of a fastener or other suitable means that permits the pivoting bracket 74 to pivot in relation to the stationary bracket 72. The pivoting brackets 74 are secured to a first mounting plate 78 by fasteners or other suitable means. The first mounting plate 78 is secured to an underside of the bottom portion 35 of the table 34 by fasteners or other suitable means. The mount 70 permits the table 34 to pivot, or tilt between a substantially horizontal position shown in FIGS. 1, 2, 6, 8, 9, and 11; and an inclined position depicted in FIGS. 3-5, 7, and 12. The pivoting of the table 34 allows the ladder 12, which is mounted on the table 34 by way of the trolley 32 and the wheel assemblies 50, to pivot between the substantially horizontal orientation corresponding to its stowed position, and the inclined orientation corresponding to its loading position.

The system 10 also includes a first locking mechanism 82 that locks the carriage 30, and the attached trolley 32 and ladder 12, in the inclined orientation shown in FIG. 3. The first locking mechanism 82 comprises an upper bracket 84 and a lower bracket 86 as illustrated in FIGS. 4-7. The lower bracket 86 is secured to the base 76 by fasteners or other suitable means. The upper bracket 84 is secured to a second mounting plate 88 by fasteners or other suitable means. The second mounting plate 88 is secured to an underside of the bottom portion 35 of the table 34 by fasteners or other suitable means.

The first locking mechanism 82 also includes a linkage 90 having an upper member 92 and a lower member 94. The upper member 92 includes two arms 95, and a web 96 that adjoins, and connects the arms 95 as can be seen in FIG. 7. The lower member 94 likewise includes two arms 97, and a web 98 that adjoins, and connects the arms 97.

A first end of the lower member 94 is coupled to the lower bracket 86 by way of a lower pin 99 or other suitable means that permits the lower member 94 to pivot in relation to the lower bracket 86, as depicted in FIGS. 4-6. A first end of the upper member 92 is coupled to the upper bracket 84 by way of an upper pin 100 or other suitable means that permits the upper member 92 to pivot in relation to the upper bracket 84, as shown in FIG. 7. A second end of the upper member 92 is coupled to a second end of the lower member 94 by way of a pivot pin 101 or other suitable means that permits the upper member 92 to pivot in relation to the lower member 94, as illustrated in FIGS. 4-7.

The locking mechanism 82 also includes a spring 102 positioned around the pivot pin 101, as depicted in FIG. 7. The spring 102 is configured to rotationally bias the upper member 92 about the upper pin 100 in the counterclockwise direction, from the perspective of FIG. 7; while rotationally biasing the lower member 94 about the lower pin 99 in the clockwise direction.

Figure 5A:
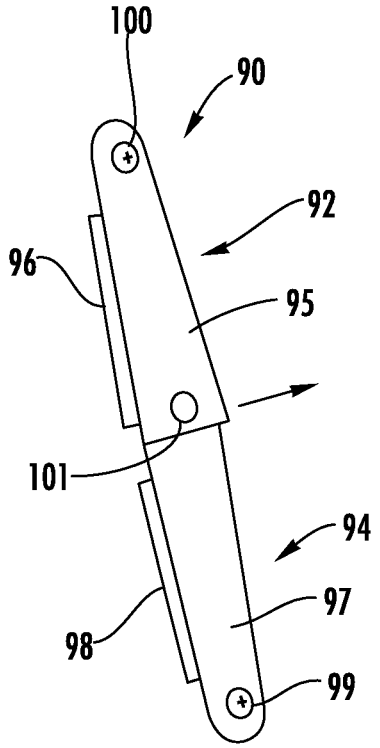
FIG. 5A is a side view of a linkage of a locking mechanism of the system shown in FIGS. 1-5, showing a pivot point of the linkage in a center position.

The linkage 90 is configured to collapse as shown in FIGS. 5 and 6 as the table 34 moves from its inclined to its horizontal position, with the lower member 94 becoming nested with the upper member 92 as the table 34 reaches its horizontal position as can be seen in FIG. 6. In particular, as the table 34 moves from its horizontal to its inclined position, the pivoting movement of the table 34 causes the linkage 90 to extend from its collapsed position shown in FIG. 6, with the pivot pin 101 acting as a pivot point between the upper and lower members 92, 94. The lower member 94 (and the pivot pin 101) rotate about the lower pin 99 in a clockwise direction; and the upper member 92 (and the pivot pin 101) rotate about the upper pin 100 in a counterclockwise direction, from the perspective of FIG. 5. The linkage 90 is configured so that, as the carriage 30 approaches its inclined position, the pivot pin 101 reaches, and passes through and past a center position, i.e., a position located directly between the lower and upper pins 99, 100, as shown in FIG. 5A, to an over-center position shown in FIGS. 4 and 7. The rotation of the pin 101 to its over-center position is encouraged by the above-noted bias of the spring 102.

The linkage 90 acts as a stop that limits rotation of the table 34 past the inclined position. In addition, the linkage 90 prevents the table 34 from pivoting back toward its horizontal position once the table 34 reaches the inclined position. In particular, the upper and lower members 92, 94 are configured so that the web 98 of the lower member 94 and the web 96 of the upper member 92 contact each other as shown in FIGS. 4 and 7 as the table 34 reaches its inclined position, and as the pivot pin 101 reaches its over-center position. This contact results in interference between the web 98 and the web 96, and the interference prevents any further movement of the pivot pin 101 past its over center position, and any further tilting of the table 34. In other words, the interference between the web 98 and the web 96 prevents further clockwise rotation of the lower member 94 (and the pivot pin 101) about the lower pin 99; and further counterclockwise rotation of the upper member 92 (and the pivot pin 101) about the upper pin 100, thereby limiting the travel of the linkage 90 (and the table 34) to the positions depicted in FIGS. 4 and 7.

The table 34, and the attached ladder 12, are inclined at an angle of approximately 45 degrees in relation to the horizontal when the table 34 reaches its inclined position. It is believed that this angle results in ready access to the ladder 12 by the firefighter or other user; while helping to minimize the extent to which the trolley 32 overhangs the back end 14*b* of the fire engine 14. Minimizing the extent to which the trolley 32 overhangs the back end 14*b* of the fire engine 14 helps to minimize the mechanical stresses on the carriage 30 and the trolley 32. Also, the back end of the trolley 32 is positioned between about 36 inches and about 48 inches above the ground when the trolley 32 is in its rearwardly-extended inclined position. Specific values for the orientation and position of the trolley 32 are provided for exemplary purposes only; these values can be varied in alternative embodiments of the system 10.

The configuration of the linkage 90 also causes the table 34 to remain locked in its inclined position. In particular, due to the kinematics of the linkage 90 at the position depicted in FIGS. 4 and 7, the combined weight of the carriage 30, the trolley 32, and the ladder 12 urges the lower member 94 (and the pivot pin 101) toward further clockwise rotation about the lower pin 99; and urges the upper member 92 (and the pivot pin 101) toward further counterclockwise rotation about the upper pin 100, from the perspective of FIG. 4. In other words, the noted weight urges the pivot pin 101 further past its over-center position. Thus, the pivot pin 101, i.e., the pivot point between the upper and lower members 92, 94, is discouraged from reversing back toward, and back through its center position shown in FIG. 5A, thereby preventing the linkage 90 from returning to its collapsed position. At the same time, the noted interference between the upper and lower members 92, 94 stops any further movement of the pivot pin 101 past its over-center position depicted in FIGS. 4 and 7. The carriage 30, therefore, will automatically become locked in, and will remain locked in its inclined position until the pivot pin 101 is retracted back toward, and then past its center position. This feature permits the user to load and unload the ladder 12 while the trolley 32 and the ladder 12 are in a secure position free from the potential for unintentional rotation which could result in injury or loss of balance to the user, or which could cause the user drop the ladder 12.

The first locking mechanism 82 further includes a release 106 that operates to release the carriage 30 from its inclined position. The release is shown in FIGS. 4, 5, 7-9, and 12. The release 106 includes an arm 108, and a slide 114. The slide 114 includes an upper member 115, two brackets 116, and two arms 117.

The slide 114 is mounted for sliding movement within in an opening 118 in the bottom portion 35 of the table 34. As shown in FIG. 8, the upper member 115 rests on the upper surface of the bottom portions 35, and straddles the opening 118. The brackets 116 are located on the underside of the bottom portion 35, on opposite sides of the opening 118 as illustrated in FIG. 4. Each bracket 116 is connected to the upper member 115 by way of a respective arm 117 secured to the upper member 115 and the bracket 116 by a suitable means such as fasteners or welding. The arms 117 act to restrain the actuator in the lateral ("x") direction, and also act as forward and rearward stops for the slider 117 in the lengthwise ("z") direction.

A first end of the arm 108 is coupled the web 96 of the upper member 92 by way of a pin or other suitable means that permits the arm 108 to pivot in relation to the upper member 92, as shown in FIGS. 4, 5, and 7. The first end of the arm 108 can be coupled the web 98 of the lower member 94 in alternative embodiments.

A second end of the arm 108 is coupled to the brackets 116 and the arms 117 by way of a pin 119 or other suitable means that permits the arm 108 to pivot in relation to the brackets 116 and the arms 117. The arm 108 has a slot 120 formed therein. The pin 119 is positioned in the slot 120 as can be seen in FIG. 7, so that the arm 108 can move linearly, as well as rotationally, in relation to the brackets 116 and the arms 117.

The release 106 also includes an actuator 121 configured to move the slide 114 and the attached arm 108. The actuator 121 is visible in FIGS. 8, 9, and 12. The actuator 121 includes a substantially L-shaped movable bracket 122, and a substantially L-shaped stationary bracket 123. The stationary bracket 123 is mounted on an inwardly-facing surface of one of the rails 40, proximate the slide 114, as can be seen in FIG. 8. The stationary bracket 123 is configured to hold the movable bracket 122, and to restrain the movable bracket 122 in the vertical ("y") and lateral ("x") directions, while permitting a limited amount of relative movement of the movable bracket 122 in the lengthwise ("z") direction.

The release 106 further comprises two springs 124. A first end of each spring 124 is connected to an end 122*a* the movable bracket 122, and a second end of each spring 124 is connected to an end 123*a* of the stationary bracket 123 as shown in FIG. 8. The springs 124 thereby bias the movable bracket 122 in a direction away from the slide 114. Alternative embodiments can include more, or less than two springs 124.

Figure 12:
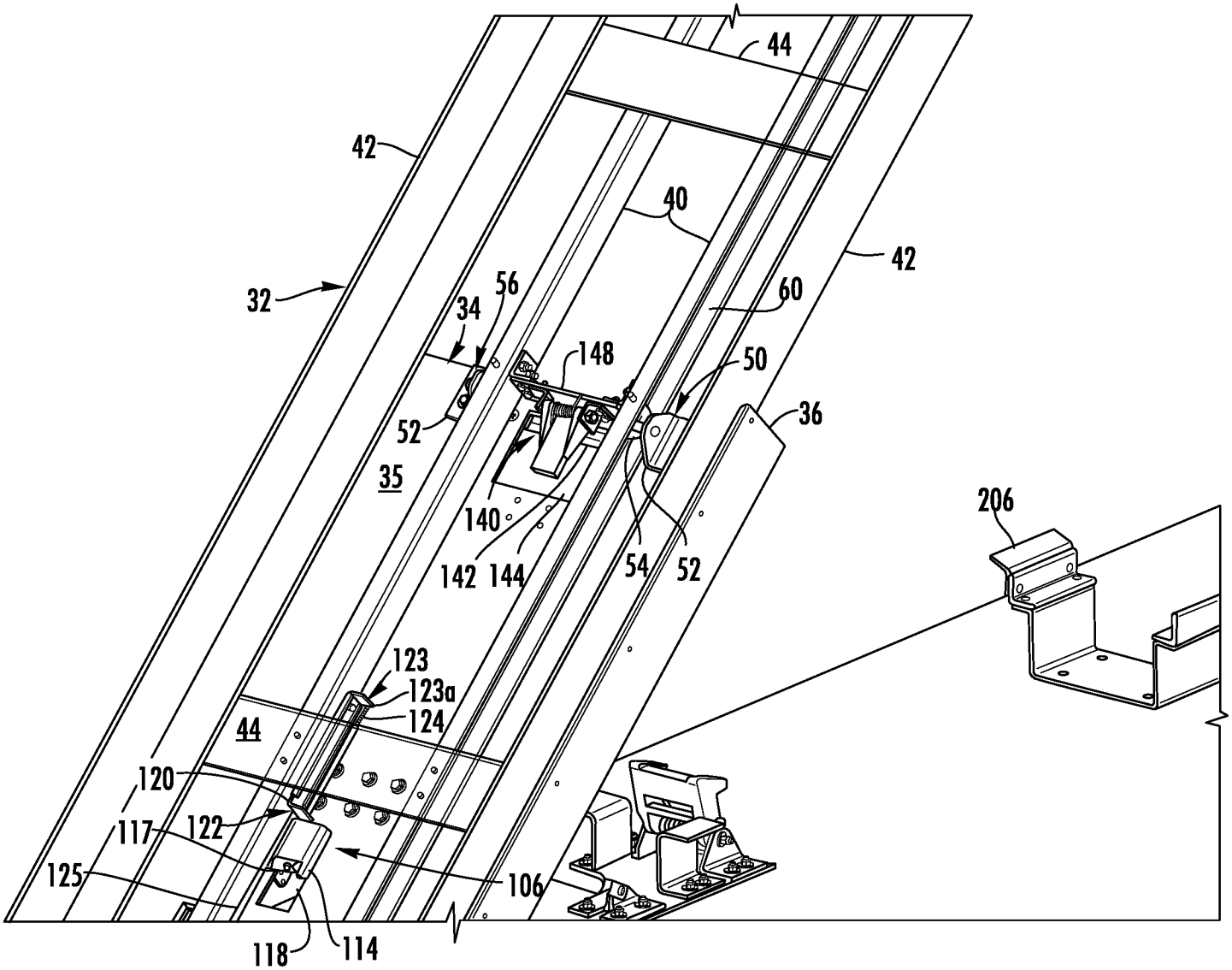
FIG. 12 is a top perspective view, looking forward, of the system shown in FIGS. 1-11, with the table locked in its inclined position, and the trolley in its rearwardly-extended, inclined position.
Figure 13:
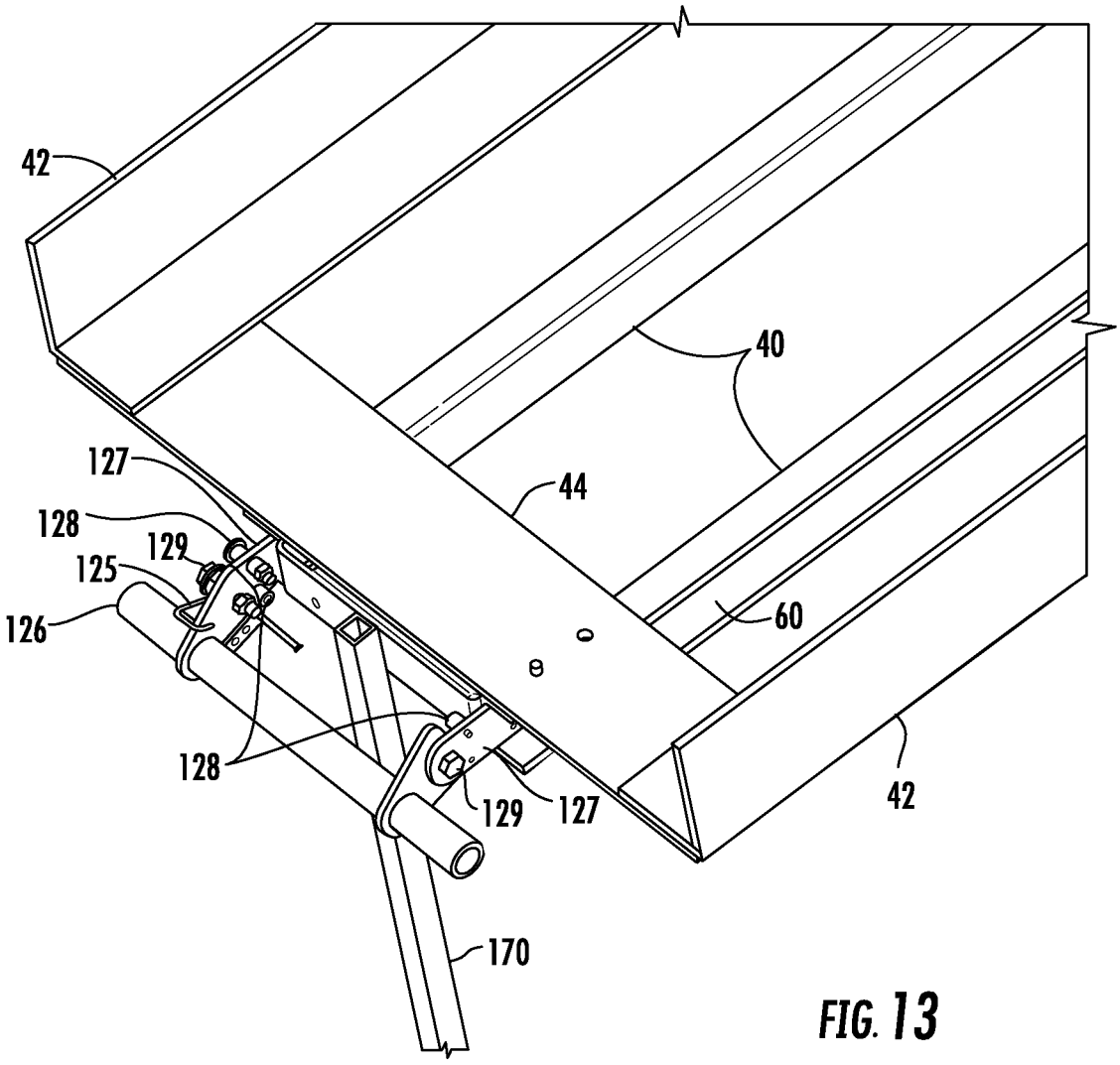
FIG. 13 is a top perspective view, looking forward, of a back end of the trolley of the system shown in FIGS. 1-12.

The release 106 also includes a cable 125, and a handle 126. A first end of the cable 125 is connected to the end 122*a* of the movable bracket 122 as shown in FIGS. 8, 9, and 12. A second end the cable is connected to the handle 126, as shown in FIG. 13. The handle 126 supported by two brackets 127. Each bracket 127 is securely mounted on the back end of a respective one of the rails 40. The handle 126 is coupled to the brackets 127 by pins 129 or other means that permit the handle 126 to pivot in relation to the brackets 127 and the rails 40. Stops 128 are mounted on the brackets 127 to limit the rotational or pivoting movement of the handle 126.

The release 106 can be activated by the user, when the user wishes to move the ladder 12 from its inclined to its horizontal orientation. This typically is done when the user wishes to store the ladder 12 after use. The release is activated by the user pushing down on the handle 126, which causes the handle 126 to rotate about the pins 129 in a counterclockwise direction from the perspective of FIG. 13. The rotation of the handle 126 places the cable 125 in tension, which in initially causes the end 122*a* of the movable bracket 122 to move toward, and into contact with the slide 114, against the bias of the springs 124. Further rotation of the handle 126 increases the tension in the cable 125, which causes the movable bracket 122 to push the slide 114 rearward, in the "z" direction. The rearward movement of the slide 114 initially pulls the pin 119 to the back end of the slot 120. Further rearward movement of the slide 114 causes the pin 119 to pull the attached arm 108 rearward. The rearward movement of the arm 108, in turn, causes the upper member 92 of the linkage 90, to which the arm 108 is attached, to rotate in a clockwise direction about the upper pin 100, from the perspective of FIG. 7. This movement draws the pivot pin 101 back toward, and back through its center position shown in FIG. 5A which, as explained above, permits the linkage 90 collapse toward the position shown in FIG. 6, thereby allowing the carriage 30, the trolley 32, and the ladder 12 to be rotated into their respective horizontal orientations.

The system 10 further comprises a dampener 190. A first end of the dampener 190 is coupled to a bracket 192 secured to the base 76, as can be seen in FIGS. 4-6. The first end of the dampener 190 is coupled to the bracket 192 by a pin or other suitable means that permits the dampener 190 to pivot in relation to the bracket 102, the base 76, and the underlying surface 18 of the fire engine 14.

A second end of the dampener 190 is coupled to the upper bracket 84 of the first locking mechanism 82. The second end of the dampener 190 is coupled to the upper bracket 84 by a pin or other suitable means that permits the dampener 190 to pivot in relation to the upper bracket 84 and the overlying table 34.

The dampener 190 dampens, and thus slows, the rotational movement of the table 34 as the table 34 rotates between its inclined and horizontal positions. The dampening can help to control the rotational speed of the table 34 as it is tilted by the user. The damping effect thereby can help to avoid damage to the system 10, ladder 12, and fire engine 14, and injury to the user, that otherwise could occur when the combined weight of the table 34, trolley 32, and ladder 12 cause the table 34 to rotate at an excessive rate.

Figure 10:
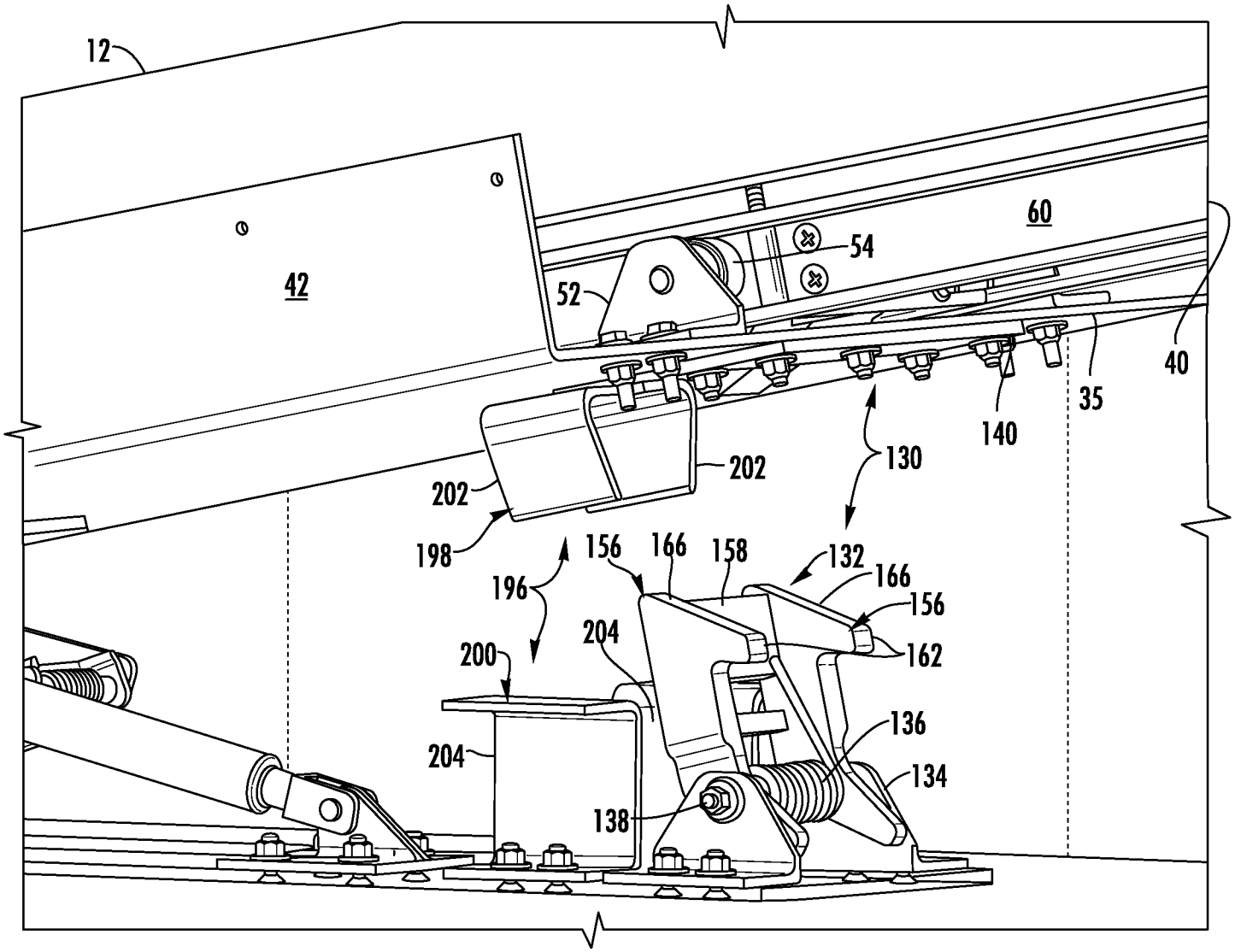
FIG. 10 is a perspective view, looking rearward, of the system shown in FIGS. 1-9, with the table moving between its horizontal and inclined positions, and the trolley moving between its rearwardly-extended inclined position and its rearwardly-extended horizontal position.

The system 10 also includes a centering mechanism 196 that helps to center the table 34 as the table 34 rotates into its horizontal orientation. The centering mechanism 196 includes a plug 198 and a receptacle 200, as illustrated in FIGS. 4, 5, and 10. The plug 198 is securely mounted on an underside of the bottom portion 35 of the table 34, by fasteners or other suitable means. The receptacle 200 is securely mounted on the base 76 by fasteners or other suitable means. The plug 198 has two tangs 202 configured to engage sides 204 of the receptacle 200 as the table 34 approaches, and reaches its horizontal orientation. The bottoms of the tangs 202 are more closely spaced from each other than the tops of the tangs 202, as can be seen in FIG. 10. This feature helps the bottom of the plug 198 to enter the receptacle 200 when some degree of misalignment is present between the plug 198 and the receptacle 200. Contact between the tangs 202 and the sides 204 of the receptacle 200 helps to center the table 34, and the other components of the system 10 mounted thereon, in relation to the base 76. Contact between the tangs 202 and the sides 204 of the receptacle 200 also helps to restrain the table 34, trolley 32, and ladder 12 in the lateral ("x") direction. The plug 198 can be mounted on the base 76, and the receptacle 200 can be mounted on the bottom portion 35 of the tray 34 in alternative embodiments.

The system 10 also can include brackets 206 mounted on the exterior surface 18 of the fire engine 14, forward of the base 76. The brackets 206 are visible in FIGS. 3 and 12. The brackets 206 are configured to engage and support the trolley 32 when the trolley 32 is in its forward position.

The system 10 also includes a second locking mechanism 130 that locks the table 34, and the attached trolley 32 and ladder 12, in the horizontal orientations shown in FIGS. 1, 2, 6, and 8-10. The second locking mechanism 130 comprises a latch 132, a bracket 134, and a spring 136, as depicted in FIGS. 4, 5, and 10. The bracket 134 is secured to the base 76 by fasteners or other suitable means. The latch 132 is coupled to the bracket 134 by a pin 138 or other suitable means that permits the latch 132 to pivot in relation to the bracket 134. The spring 136 is positioned around the pin 138, and rotationally biases the latch 132 about the pin 138 in a clockwise direction, from the perspective of FIG. 10. As shown in FIG. 10, the latch 132 includes two hook portions 156, and a web 158 that adjoins, and connects the hook portions 156.

Figure 11:
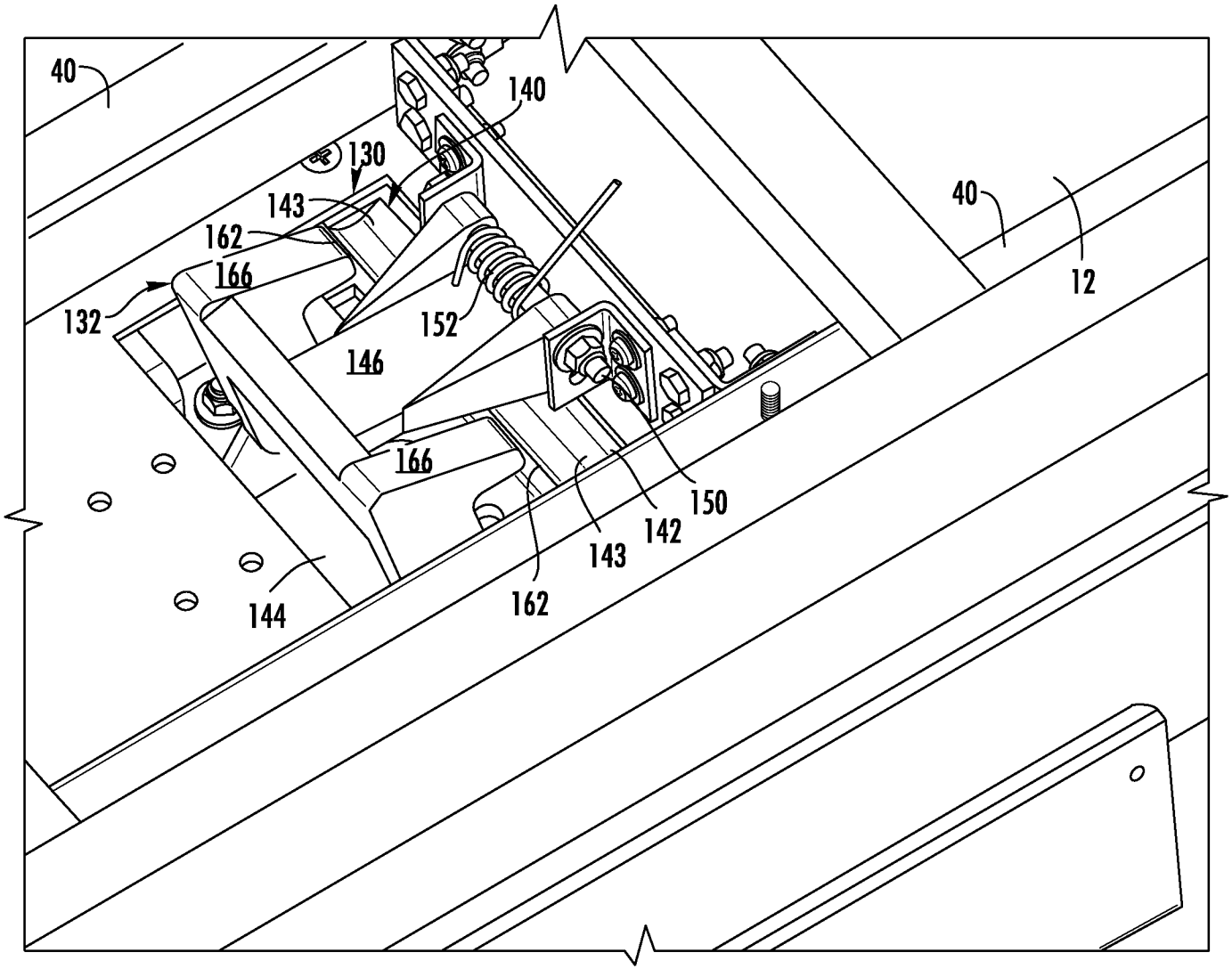
FIG. 11 is a magnified view of the area designated "B" in FIG. 9.

The second locking mechanism 130 also includes a catch 140, which is visible in FIGS. 4 and 9-12. The catch 140 is secured to the underside of the bottom portion 35 of the table 34 by fasteners or other suitable means. The catch 140 has a first portion 142 with an upwardly-facing recess 143 formed therein. The first portion 142 is aligned with an opening 144 formed in the bottom portion 35 of the table 34. The recess 143 thus is accessible from above, as shown in FIGS. 9, 11, and 12.

The latch 132 can retain the table 34, trolley 32, and ladder 12 in their horizontal orientations. In particular, the second locking mechanism 130 is configured so that ends 162 the hook portions 156 of the latch 132 contact the recessed area 143 in the catch 142 when the table 34 is in its horizontal orientation, with the bias of the spring 136 urging the ends 162 into contact with the recessed area 143. Thus, any upward tilting of the table 34, i.e., rotation of the table 34 in the counterclockwise direction from the perspective of FIG. 10, is prevented by interfering contact between the catch 142, which is secured to the table 34; and the latch 132, which is secured to the exterior surface 18 of the fire engine 14 by way of the bracket 134 and the base 76.

The latch 132 is configured to automatically engage the catch 140 as the table 34 rotates from its inclined to its horizontal position. In particular, as the table 34 approaches its horizontal position, a rearward edge of the first portion 142 of the catch 140 comes into contact with an angled upper surface 166 on each of the hook portions 156 of the latch 132. Further rotation of the table 34 results in interfering contact between the upper surfaces 166 and the first portion 142 of the catch 140. Due to the angled orientation of the upper surfaces 166, this contact causes the latch 132 to rotate in a counterclockwise direction from the perspective of FIG. 10, against the bias of the spring 136, as the upper portion of the latch 132 passes through the opening 144. The latch 132 continues to rotate in this manner until the ends 162 of the hook portion 156 reach and pass over the edge of the first portion 140, at which point of the bias of the spring 136 causes the latch 132 to rotate clockwise, which in turn causes the hook portions 156 to engage the upper surface of the bottom portion 35 of the table 34, thereby locking the table 34 is in its horizontal orientation.

The second locking mechanism 130 includes features that unlock the table 34 so that the table 34 can rotate to its inclined position. In particular, the second locking mechanism 130 further comprises a tongue 146, and a bracket assembly 148. The bracket assembly 148 is positioned between the rails 40 as shown in FIGS. 9, 11, and 12, and is secured to the rails 40 by fasteners or other suitable means. As can be seen in FIG. 11, the tongue 146 is coupled to the bracket assembly 148 by a pin 150 or other suitable means that permits the tongue 146 to pivot in relation to the bracket assembly 148. The second locking mechanism 130 further comprises a spring 152 positioned around the pin 150. The spring 152 rotationally biases the tongue 146 about the pin 150 in a clockwise direction, from the perspective of FIG. 11. A stop (not shown) causes the tongue 146 to remain in a substantially horizontal orientation when it is not being contacted by the latch 132 as discussed below.

Because the tongue 146 is mounted on the rails 40, the tongue 146 moves linearly, in the "z" direction, with the trolley 32. The tongue 146 is configured to release the latch 132 when the trolley 32 reaches its rearwardly-extended position. In particular, as the trolley 32 approaches its rearwardly-extended horizontal position shown in FIG. 2, the tongue 146, which is aligned with the web 158 of the latch 132, contacts the web 158. Further rearward movement of the trolley 32 toward its rearwardly-extended position causes the tongue 146 to push against the web 158 in a rearward direction, which in turn causes the latch 132 to rotate about the pin 138 in a counterclockwise direction from the perspective of FIG. 11, against the bias of the spring 136. The rotation of the latch 132 eventually moves the hook portions 156 out of contact with the table 34 as shown in FIGS. 9 and 11, thereby removing the restraint on the tilting movement of the table 34. The table 34, and the trolley 32 and the ladder 12 thus can be moved to their inclined orientations at this point. It follows also that the trolley 32 will remain locked in its horizontal orientation whenever the trolley 32 is located at any point forward of its rearwardly-extended position. This feature can prevent the trolley 32 from being rotated prematurely, i.e., before the trolley 32 reaches its rearwardly-extended position, thereby preventing interference between, and damage to the trolley 32 and the fire engine 14, and possible injury to the individual retrieving or storing the ladder 12, that otherwise could occur as a result of premature rotation of the trolley 32.

The ability of the tongue 146 to pivot permits the tongue 146 to move past the now stationary latch 132 as the tongue 146 moves upward with the trolley 32. Once the tongue 146 has cleared the latch 132, the latch 132 returns to its neutral position, depicted in FIG. 12, due to the bias of the spring 136. The latch 132 is then ready to re-engage the catch 140 when the table 34 is returned to its horizontal orientation.

The system 10 further includes a second handle 170, depicted in FIGS. 1-3, 13, and 14. The handle 170 is securely mounted on a bracket 172, which in turn is securely mounted on the back ends the rails 40. The handle 170 can be utilized by the user to pull and push the trolley 32 (and the attached ladder 12) between its forward and rearwardly-extended positions. The handle 170 has a length sufficient to allow the user to move the trolley 32 while standing on the ground.

Figure 14:
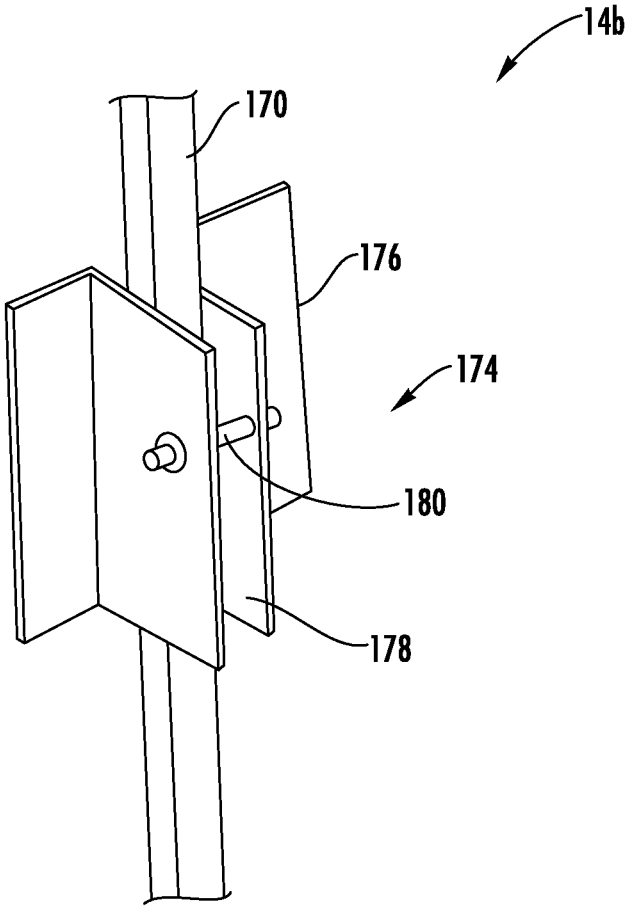
FIG. 14 is a magnified view of the area designated "A" in FIG. 1.

The system 10 can include a handle catch 174, shown in FIGS. 1 and 14, to restrain the trolley 32 from rearward movement while the trolley 32 is in its stowed position. The handle catch 174 includes a bracket 176. The bracket 176 defines a receiving area 178 that receives, and partially encloses a portion of the handle 170 when the trolley 32 is in its forward-most position. The handle catch 174 also includes a pin 180 that is configured to extend across the receiving area 176 as shown in FIG. 14, so that interfering contact between the pin 180 and the handle 170 prevents rearward movement of the trolley 32 (and the attached ladder 12). Alternative embodiments of the system 10 can include features other than the handle catch 174 to restrain the trolley 32 from rearward movement.

The system 10 thus can facilitate the storage and retrieval of objects such as ladders in spaces where it otherwise may not be feasible to store such objects. It is believed that the automatic locking and unlocking features of the system 10 can enhance the safety and speed with which ladders and other objects can be retrieved from, and returned to storage areas such as the roof of an emergency vehicle, where physical and visual access may be limited. Also, while the use of the system 10 is not limited to firefighting and other emergency operations, it is believed that the use of the system 10 can be particularly beneficial during such operations, where time is of the essence and which often take place in adverse weather and lighting conditions.

Alternative embodiments of the system 10 can be configured without the first locking mechanism 82 or the second locking mechanism 130, and without a movable trolley. Also, alternative embodiments can be equipped with motorized features for causing the tray 34 to pivot, or for causing the trolley 32 to move between its forward and rearwardly-extended positions.

PARTS LIST system 10
ladder 12
fire engine 14
forward end 14*a*
back end 14*b*
exterior surface 18
carriage 30
trolley 32
table 34
bottom portion 35
sides 36
rails 40
brackets 42
cross members 44
wheel assemblies 50
brackets 52
wheels 54
channel 60
forward stop 68
mount 70
stationary brackets 72
pivoting brackets 74
base 76
first mounting plate 78
first locking mechanism 82
upper bracket 84
lower bracket 86
second mounting plate 88
linkage 90
upper member 92
lower member 94
arms 95
web 96
two arms 97 web 98
lower pin 99
upper pin 100
locking pin 101
spring 102
release 106
arm 108
slide 114
upper member 115
brackets 116
arms 117
opening 118
pin 119
slot 120
actuator 121
movable bracket 122
end 112*a*
stationary bracket 123
end 123*a*
springs 124
cable 125
handle 126
brackets 127
stops 128
pins 129
second locking mechanism 130
latch 132
bracket 134
spring 136
pin 138
catch 140
first portion 142
recess 143
opening 144
a tongue 146
bracket assembly 148
pin 150
spring 152
hook portions 156
web 158
upper surface 166
handle 170
handle catch 174
bracket 176
receiving area 178
pin 180
dampener 190
bracket 192
centering mechanism 196
plug 198
receptacle 200
tangs 202
sides 204
brackets 206

What is claimed is:

1. A system for storing and retrieving an object, comprising:

a carriage comprising a table configured to rotate between a first and a second angular position in relation to a mounting surface for the system;

a trolley mounted on the carriage and configured to hold the object; and a first locking mechanism comprising a linkage, wherein: the linkage comprises a first member and a second member; the first member is pivotally coupled to the table at a first pivot point; the second member is configured to be pivotally coupled to the mounting surface at a second pivot point; the first member comprises a first and a second arm, and a web that adjoins the first and second arms; the second member is pivotally coupled to the first member at a third pivot point; the second member comprises a first and a second arm, and a web that adjoins the first and second arms of the second member; and the linkage is configured so that interfering contact between the webs of the first and second members prevents movement of the table past the second angular position.

2. The system of claim 1, wherein the linkage is further configured so that the third pivot point passes between the first and second pivot points as table rotates between the first and a second angular positions.

3. The system of claim 1, wherein the trolley is configured to move in relation to the carriage between a first and a second position.

4. The system of claim 3, further comprising a second locking mechanism, the second locking mechanism comprising:

a latch movable between a first position wherein the latch is configured to contact the table and retain the table in the first angular position; and a second position; and a tongue mounted on the trolley and configured to urge the latch into the second position of the latch when the trolley is in the second position of the trolley.

5. The system of claim 4, wherein the tongue is configured to disengage from the latch when the trolley is moved away from the second position of the trolley, and the latch is configured to return to the first position when the tongue disengages from the latch.

6. The system of claim 4, wherein the latch is configured to deflect in response to contact with the table as the table moves from the second to the first angular position, and to return to the first position of the latch when the table reaches the first angular position.

7. The system of claim 4, wherein the table has an opening formed therein and configured to receive the latch as the table moves from the second to the first angular position.

8. The system of claim 1, further comprising a base configured to be mounted on the mounting surface, and a bracket mounted on the base, wherein the first arm member is pivotally coupled to the bracket and the carriage is mounted on the base.

9. The system of claim 1, wherein the linkage is configured so that a weight of the table and the trolley urges the first and second members toward interfering contact when the table is in the second angular position whereby movement of the table toward the first angular position is discouraged.

10. The system of claim 1, wherein the trolley is configured to hold a ladder.

11. A system for storing and retrieving an object, comprising:

a carriage comprising a table configured to rotate between a first and a second angular position in relation to a mounting surface for the system;

a trolley mounted on the carriage and configured to hold the object; and a locking mechanism comprising a linkage and a release, wherein:

the linkage comprises a first member and a second member; the first member is pivotally coupled to the table at a first pivot point; the second member is configured to be pivotally coupled to the mounting surface at a second pivot point; the second member is pivotally coupled to the first member at a third pivot point;

the linkage is configured so that interfering contact between the first and second members prevents movement of the table past the second angular position; and the release comprises an arm pivotally coupled to one of the first and second members, and an actuator coupled to the arm and configured to move the arm when the table is in the second angular position so that the table moves toward the first angular position and the third pivot point passes between the first and second pivot points as the table moves toward the first angular position.

12. The system of claim 11, wherein the release further comprises a slider slidably coupled to the table, pivotally coupled to the arm, and configured to transmit force from the actuator to the arm.

13. The system of claim 12, wherein the release further comprises a handle rotatably coupled to the trolley, and a cable connected to the actuator and the handle, wherein the cable is configured to exert a force on the actuator in response to rotation of the handle.

14. A system for storing and retrieving an object, comprising:

a carriage comprising a table configured to rotate between a first and a second angular position in relation to a mounting surface for the system;

a trolley mounted on the carriage, the trolley being configured to hold the object, and to move in relation to the carriage between a first and a second position; and a locking mechanism comprising:

a latch movable between a first position and a second positon, wherein the latch is configured to contact the table and retain the table in the first angular position of the table when the latch is in the first positon of the latch; and the latch is further configured to be disengaged from the table when the latch is in the second position of the latch so that the table can move between the first and second angular positions of the table; and a tongue mounted on the trolley, the tongue being configured to be urged into contact with the latch by movement of the trolley to the second position of the trolley, and to move the latch into the second position of the latch when urged into contact with the latch; wherein the tongue is further configured to disengage from the latch when the trolley is moved away from the second position of the trolley, and the latch is further configured to return to the first position of the latch when the tongue disengages from the latch.

15. A system for storing and retrieving an object, comprising:

a carriage comprising a table configured to rotate between a first and a second angular position in relation to a mounting surface for the system;

a trolley mounted on the carriage and configured to hold the object; and a first locking mechanism comprising a linkage, and a release, wherein: the linkage comprises a first member pivotally coupled to the table, and a second member pivotally coupled to the first member at a pivot point and configured to be pivotally coupled to the mounting surface; the linkage is configured so that the linkage is in a collapsed state when the table is in the first angular position, and the pivot point undergoes over-center rotation as the table moves from the first to the second angular position; and the release comprises an arm pivotally coupled to one of the first and second members, and an actuator coupled to the arm and configured to move the arm when the table is in the second angular position so that the table moves toward the first angular position and the linkage can return to the collapsed state.

16. The system of claim 15, wherein the trolley is configured to move in relation to the carriage between a first and a second position.

17. The system of claim 16, further comprising a second locking mechanism, the second locking mechanism comprising:

a latch movable between a first position wherein the latch is configured to contact the table and retain the table in the first angular position; and a second position; and a tongue mounted on the trolley and configured to urge the latch into the second position of the latch when the trolley is in the second position of the trolley.

18. The system of claim 17, wherein the tongue is configured to disengage from the latch when the trolley is moved away from the second position of the trolley, and the latch is configured to return to the first position when the tongue disengages from the latch.

19. The system of claim 15, wherein the linkage is configured so that interfering contact between the first and second members prevents movement of the table past the second angular position and a weight of the table and the trolley urges the first and second members toward interfering contact when the table is in the second angular position whereby movement of the table toward the first angular position is discouraged.

* * * * *